US012435281B2

(12) United States Patent
Cukierman et al.

(10) Patent No.: US 12,435,281 B2
(45) Date of Patent: Oct. 7, 2025

(54) PROCESS FOR THE PRODUCTION OF WHITE OILS

(71) Applicant: TOTALENERGIES ONETECH, Courbevoie (FR)

(72) Inventors: Serge Cukierman, Neuilly sur Seine (FR); Cyrille Bodin, Houston, TX (US); Cristina Ferreira, Paris (FR)

(73) Assignee: TOTALENERGIES ONETECH, Courbevoie (FR)

( * ) Notice: Subject to any disclaimer, the term of this patent is extended or adjusted under 35 U.S.C. 154(b) by 29 days.

(21) Appl. No.: 18/006,676

(22) PCT Filed: Aug. 5, 2021

(86) PCT No.: PCT/EP2021/071877
§ 371 (c)(1),
(2) Date: Jan. 24, 2023

(87) PCT Pub. No.: WO2022/029232
PCT Pub. Date: Feb. 10, 2022

(65) Prior Publication Data

US 2023/0235237 A1 Jul. 27, 2023

(30) Foreign Application Priority Data

Aug. 7, 2020 (EP) ..... 20305910

(51) Int. Cl.
*C10G 45/46* (2006.01)
*C10G 67/02* (2006.01)

(52) U.S. Cl.
CPC ..... *C10G 45/46* (2013.01); *C10G 67/02* (2013.01); *C10G 2300/1044* (2013.01); *C10G 2300/1059* (2013.01); *C10G 2300/202* (2013.01); *C10G 2300/301* (2013.01); *C10G 2300/302* (2013.01); *C10G 2300/304* (2013.01); *C10G 2300/4006* (2013.01); *C10G 2300/4018* (2013.01); *C10G 2400/14* (2013.01)

(58) Field of Classification Search
CPC ..... C10G 67/02; C10G 2300/202; C10G 2300/302; C10G 2300/304; C10G 2300/308; C10G 2400/04; C10G 2400/10; C10G 2400/14; C10G 45/46; C10G 2300/1044; C10G 2300/1059; C10G 2300/301; C10G 2300/4006; C10G 2300/4018; C10G 2300/1055; C10M 101/02; C10M 177/00; C10M 2203/1006; C10N 2070/00
See application file for complete search history.

(56) References Cited

U.S. PATENT DOCUMENTS

| | | | | | |
|---|---|---|---|---|---|
| 4,325,804 | A * | 4/1982 | Everett | C10G 65/12 | 208/143 |
| 5,122,258 | A * | 6/1992 | Eadie | B01J 27/0515 | 502/220 |
| 2009/0166251 | A1* | 7/2009 | Hantzer | C10G 45/04 | 208/58 |
| 2014/0291201 | A1* | 10/2014 | Banerjee | C10G 65/04 | 208/89 |
| 2015/0315493 | A1* | 11/2015 | Morel | C10G 65/04 | 585/240 |
| 2018/0155636 | A1* | 6/2018 | Germanaud | C10G 45/58 | |
| 2020/0002626 | A1 | 1/2020 | Dupuy | | |

FOREIGN PATENT DOCUMENTS

| | | | | |
|---|---|---|---|---|
| CA | 2816628 | A1 * | 6/2012 | B01J 29/146 |
| CN | 107629817 | A | 1/2018 | |
| EP | 2501785 | A | 9/2012 | |
| WO | 2022029232 | A1 | 2/2022 | |

OTHER PUBLICATIONS

ISR-WO for parent application PCT/EP2021/071877 dated Oct. 28, 2021.

* cited by examiner

*Primary Examiner* — Prem C Singh
*Assistant Examiner* — Juan C Valencia
(74) *Attorney, Agent, or Firm* — Vorys, Sater, Seymour and Pease, LLP

(57) ABSTRACT

The invention is a process for producing a white oil having an initial boiling point of at least 300° C., the process comprising a step of catalytically hydrogenating a hydrocarbon feedstock at a temperature of from 80 to 190° C., at a pressure of from 50 to 160 bars, a liquid hourly space velocity of 0.2 to 5 $hr^{-1}$ and an hydrogen treat rate up to 200 $Nm^3$/ton of feed, the hydrocarbon feedstock having a sulphur content of less than 10 ppm by weight, an initial boiling point within the range from 150 to 350° C. and a final boiling point within the range from 350 to 550° C.

19 Claims, No Drawings

PROCESS FOR THE PRODUCTION OF WHITE OILS

FIELD OF THE INVENTION

The invention relates to a process for the production of white oils having a very low aromatic content.

BACKGROUND ART

White oils are known for the skilled person and correspond to highly refined mineral oils and thus are of high purity. White oils generally fall into two classes, technical grade and medicinal grade. Medicinal grade white oils are typically chemically inert and substantially without color, odor, or taste. The technical grade white oils are generally used in, textile lubrication, sealants, adhesives or bases for insecticides. The more highly refined medicinal grade white oils are those suitable for use in drug compositions, foods, cosmetics and for the lubrication of food handling machinery.

White oils have high stability properties, in particular high thermal stability, are chemically inert, without odor and without color. White oils are notably defined in the Code of Federal Regulation of the FDA for example in sections 21 C.F.R. § 172.878 regarding direct food additives, 21 C.F.R. § 178.3620 (a) regarding indirect food additives, 21 C.F.R. § 573.680 regarding animal food additives and H1 food processing lubricant standards, 21 C.F.R. § 178.3620 (b) regarding indirect food additives and 21 C.F.R. § 573.680 regarding animal food additives. White oils are also defined in the French and European Pharmacopoeia.

White oils are generally produced by refining an appropriate petroleum feedstock to remove oxygen, nitrogen, and sulfur compounds, reactive hydrocarbons such as aromatics, and any other impurity which would prevent use of the resulting white oil in the pharmaceutical or food industry.

EP 1 171 549 discloses a hydrofining process of a hydrocarbon feedstock at temperatures ranging from 200 to 400° C. in order to produce white oils.

The inventors surprisingly discovered that the processes of the prior art leads to by-products and thus to a loss of yield of the process.

There is thus a need for a process for producing white oils with higher yields, with a process easy to implement and with a reduced cost.

SUMMARY OF THE INVENTION

The invention provides a process for producing a white oil having an initial boiling point of at least 300° C., the process comprising a step of catalytically hydrogenating a hydrocarbon feedstock at a temperature of from 80 to 190° C., at a pressure of from 50 to 160 bars, a liquid hourly space velocity of 0.2 to 5 hr−1 and an hydrogen treat rate up to 200 Nm3/ton of feed, the hydrocarbon feedstock having a sulphur content of less than 10 ppm by weight, an initial boiling point within the range from 150 to 350° C. and a final boiling point within the range from 350 to 550° C.

According to an embodiment, the feedstock comprises less than 8 ppm by weight of sulphur, preferably less than 6 ppm by weight of sulphur.

According to an embodiment, the feedstock has an initial boiling point ranging from 160 to 350° C., preferably from 170 to 325° C., more preferably from 200 to 325° C.

According to an embodiment, the feed has a final boiling point in the ranging from 350 to 550° C., preferably from 375 to 525° C., more preferably from 410 to 525° C.

According to an embodiment, the feedstock has a viscosity at 40° C. of at least 2 cSt, preferably at least 3 cSt.

According to an embodiment, the feedstock has an aromatic content ranging from 3 to 30% by weight, more preferably from 5 to 20% by weight.

According to an embodiment, the hydrogenating temperature ranges from 100 to 190° C., preferably from 120 to 190° C., more preferably from 130 to 180° C.

According to an embodiment, the hydrogenating pressure ranges from 75 to 160 bars, preferably from 100 to 160 bars, more preferably from 120 to 150 bars.

According to an embodiment, the process of the invention further comprises a fractionating step, preferably performed after the hydrogenating step.

According to an embodiment, the white oil has an aromatic content below 500 ppm by weight, preferably below 400 ppm, more preferably below 350 ppm by weight, even more preferably below 320 ppm by weight.

According to an embodiment, the white oil has an initial boiling point higher than 300° C., preferably higher than 310° C.

The inventors surprisingly found that the hydrogenation of a heavy gasoil cut can lead to a heavy fraction having low aromatic contents. Indeed, after a step of hydrogenation of a heavy gasoil cut, it was generally expected that heavy fractions, i.e. fractions with a boiling range within 300-450° C., have a relatively high aromatic contents.

White oils produced thanks to the process of the invention reply to the purity criterion of the European Pharmacopoeia (monography on liquid paraffins of pharmacopeia EuPh 6.0 January 2008), of the US Pharmacopeia (US Pharmacopoeia Light Mineral Oil, USP32-NF 27), and of the Japanese Pharmacopeia (Japanese Pharmacopoeia Light liquid Paraffin).

DESCRIPTION OF EMBODIMENTS OF THE INVENTION

The present invention relates to a process for producing a white oil having an initial boiling point of at least 300° C., the process comprising a step of catalytically hydrogenating a hydrocarbon feedstock at a temperature of from 80 to 190° C., at a pressure of from 50 to 160 bars, a liquid hourly space velocity of 0.2 to 5 $hr^{-1}$ and an hydrogen treat rate up to 200 $Nm^3$/ton of feed, the hydrocarbon feedstock having a sulphur content of less than 10 ppm by weight, an initial boiling point within the range from 150 to 350° C. and a final boiling point within the range from 350 to 550° C.

Within the meaning of the present invention, the IBP is different from the FBP of a product, this applies for example for the feedstock and for the white oil.

Feedstock (Also Named "Feed"):

The feedstock is a hydrocarbon feedstock having a sulphur content of less than 10 ppm by weight, an initial boiling point (IBP) within the range from 150 to 350° C. and a final boiling point (FBP) within the range from 350 to 550° C.

The sulphur content can be measured according to ASTM D2622 standard using X-ray Fluorescence. The IBP and FBP can be measured according to ASTM D86 standard.

According to a preferred embodiment, the feedstock has a sulphur content of less than 8 ppm by weight, preferably less than 7 ppm by weight. The sulphur content can be measured by UV spectrometry.

According to a particular embodiment, the feed has an IBP ranging from 160 to 350° C., preferably from 170 to 325° C., more preferably from 200° C. to 325° C.

According to a particular embodiment, the feed has a FBP ranging from 350 to 550° C., preferably from 375 to 525° C., more preferably from 410 to 525° C.

According to a specific embodiment, the feed has an IBP ranging from 200° C. to 325° C. and a FBP ranging from 410 to 525° C.

According to an embodiment of the invention the feedstock has an aromatic content ranging from 3 to 30% by weight, preferably from 4 to 20% by weight, more preferably from 5 to 15% by weight. The aromatic content of the feed can be measured by HPLC (high performance liquid chromatography), for example according to IP391 standard.

According to an embodiment of the invention, the feed comprises from 40 to 80% by weight of paraffins, preferably from 60 to 80% by weight of paraffins, based on the total weight of the feed. Preferably, the weight ratio between the isoparaffins and the n-paraffins ranges from 2 to 4.

According to an embodiment of the invention, the feed comprises from 10 to 40% by weight of naphthens, preferably from 15 to 35% by weight of naphthens, based on the total weight of the feed.

The feed typically has a viscosity at 40° C. of at least 2 $mm^2/s$, preferably at least 3 $mm^2/s$. The viscosity can be measured according to ASTM D445 standard.

According to an embodiment of the invention, the feedstock has a density at 15° C. ranging from 0.8100 to 0.8500 g/mL, preferably from 0.8200 to 0.8400 g/mL. The density at 15° C. can be measured according to ISO 12185 standard.

The process of the invention can typically comprises a step of providing a feedstock as defined in the present invention, before the step of catalytically hydrogenating, for example a feedstock comprising a sulphur content of less than 10 ppm by weight, having an IBP ranging from 170 to 325° C. and having a FBP ranging from 375 to 525° C.

Typically, the feedstock is a heavy gasoil cut which can be obtained by direct distillation of crude hydrocarbons, vacuum distillates, hydrotreated distillates, distillates derived from the catalytic cracking and/or hydrocracking of vacuum distillates, distillates resulting from conversion processes such as ARDS (atmospheric residue desulfurization) and/or visbreaking, and distillates derived from the upgrading of Fischer-Tropsch cuts, preferably by hydrocracking of crude hydrocarbons.

Hydrogenation Step.

The feedstock is hydrogenated. The feedstock can optionally be pre-fractionated.

Hydrogen that is used in the hydrogenation unit is typically a high purity hydrogen, e.g. with a purity of more than 99%, albeit other grades can be used.

Hydrogenation takes place in one or more reactors. The reactor can comprise one or more catalytic beds. Catalytic beds are usually fixed beds.

Hydrogenation takes place using a catalyst. Typical hydrogenation catalysts include but are not limited to: nickel, platinum, palladium, rhenium, rhodium, nickel tungstate, nickel molybdenum, molybdenum, cobalt molybdenate, nickel molybdenate on silica and/or alumina carriers or zeolites. A preferred catalyst is Ni-based and is supported on an alumina carrier, having a specific surface area varying between 100 and 200 $m^2/g$ of catalyst. According to a particular embodiment, the catalyst consists in nickel as metallic compound.

The hydrogenation conditions are typically the following:

- Pressure: 50 to 160 bars, preferably 75 to 160 bars, and most preferably 100 to 160 bars or from 120 to 150 bars;
- Temperature: 80 to 190° C., preferably 100 to 190° C. and most preferably 120 to 190° C. or from 130 to 180° C.;
- Liquid hourly space velocity (LHSV): 0.2 to 5 $hr^{-1}$, preferably 0.4 to 3, and most preferably 0.5 to 1.5;
- Hydrogen treat rate: adapted to the above conditions, which can be up to 200 $Nm^3$/ton of feed.

According to a particular embodiment, the hydrogenating pressure ranges from 120 to 150 bars and the hydrogenating temperature ranges from 120 to 190° C.

The hydrogenation process of the invention can be carried out in several stages. There can be two or three stages, preferably three stages, preferably in three separate reactors. The first stage will operate the sulphur trapping, hydrogenation of substantially all unsaturated compounds, and up to about 90% of hydrogenation of aromatics. The flow exiting from the first reactor contains substantially no sulphur. In the second stage the hydrogenation of the aromatics continues, and up to 99% of aromatics are hydrogenated. The third stage is a finishing stage, allowing an aromatic content as low as 1000 ppm by weight or even less such as below 500 ppm, more preferably less than 200 ppm, even for high boiling products.

The catalysts can be present in varying or substantially equal amounts in each reactor, e.g. for three reactors according to weight amounts of 0.05-0.5/0.10-0.70/0.25-0.85, preferably 0.07-0.25/0.15-0.35/0.4-0.78 and most preferably 0.10-0.20/0.20-0.32/0.48-0.70.

It is also possible to have one or two hydrogenation reactors instead of three.

It is also possible that the first reactor be made of twin reactors operated alternatively in a swing mode. This may be useful for catalyst charging and discharging: since the first reactor comprises the catalyst that is poisoned first (substantially all the sulphur is trapped in and/or on the catalyst) it should be changed often.

One reactor can be used, in which two, three or more catalytic beds are installed.

It may be necessary to insert quenches on the recycle to cool effluents between the reactors or catalytic beds to control reaction temperatures and consequently thermodynamic equilibrium of the hydrogenation reaction. In a preferred embodiment, there is no such intermediate cooling or quenching.

In case the process makes use of 2 or 3 reactors, the first reactor will act as a sulphur trap. This first reactor will thus trap substantially all the sulphur. The catalyst will thus be saturated quickly and may be renewed from time to time. When regeneration or rejuvenation is not possible for such saturated catalyst the first reactor is considered as a sacrificial reactor which size and catalyst content both depend on the catalyst renewal frequency.

In an embodiment the resulting product and/or separated gas is/are at least partly recycled to the inlet of the hydrogenation stages. This dilution helps, if this were to be needed, maintaining the exothermicity of the reaction within controlled limits, especially at the first stage. Recycling also allows heat-exchange before the reaction and also a better control of the temperature.

The stream exiting the hydrogenation unit contains the hydrogenated product and hydrogen. Flash separators are used to separate effluents into gas, mainly remaining hydrogen, and liquids, mainly hydrogenated hydrocarbons. The process can be carried out using three flash separators, one of high pressure, one of medium pressure, and one of low pressure, very close to atmospheric pressure.

The hydrogen gas that is collected on top of the flash separators can be recycled to the inlet of the hydrogenation unit or at different levels in the hydrogenation units between the reactors.

Because the final separated product is at about atmospheric pressure, it is possible to feed directly the optional fractionation stage, which is preferably carried out under vacuum pressure that is at about between 10 to 50 mbars, preferably about 30 mbars.

The optional fractionation stage can be operated such that various hydrocarbon fluids can be withdrawn simultaneously from the fractionation column, and the boiling range of which can be predetermined.

Therefore, fractionation can take place before hydrogenation, after hydrogenation, or both.

The hydrogenation reactors, the separators and the fractionation unit can thus be connected directly, without having to use intermediate tanks. By adapting the feed, especially the initial and final boiling points of the feed, it is possible to produce directly, without intermediate storage tanks, the final products with the desired initial and final boiling points. Moreover, this integration of hydrogenation and fractionation allows an optimized thermal integration with reduced number of equipment and energy savings.

White Oils

The invention thus discloses a white oil cut that can be obtained by the process of the invention. The white oil cut typically has an initial boiling point of at least 300° C. and an aromatic content of less than 500 ppm by weight. The aromatic content can be measured by UV spectrometry.

According to an embodiment, the white oil has a final boiling point ranging from 350 to 420° C., preferably from 380 to 410° C.

According to a preferred embodiment, the aromatic content of the white oil is less than 400 ppm by weight, preferably less than 350 ppm by weight, more preferably less than 320 ppm by weight. The specifically low aromatic content can be obtained thanks to the hydrogenating step performed in such a manner that the aromatic content is substantially reduced. As a non-limiting example, the hydrogenating step can be performed in two or three successive stages, preferably in two or three successive reactors, in order to deeply reduced the aromatic content.

According to a preferred embodiment, the white oil obtained in the invention has (all) its boiling points within the range of from 300 to 420° C., preferably from 310 to 410° C.

According to an embodiment, the white oil obtained in the invention has one or several of the following features:

- a density at 15° C. ranging from 0.8200 to 0.8700 g/mL, preferably from 0.8300 to 0.8500 g/mL, and/or
- a Saybolt colour higher than or equal to +30, measured according to NF M 07003 standard, and/or
- a viscosity at 40° C. ranging from 7 to 25 $mm^2/s$, preferably from 10 to 20 $mm^2/s$, and/or
- an aniline point of at least 70° C., preferably at least 90° C., more preferably at least 98° C., measured according to ISO 2977 standard, and/or
- a pour point ranging from −40° C. to +10° C., preferably from −30° C. to −5° C., measured according to ISO 3016 standard, and/or
- a refractive index at 20° C. ranging from 1.4500 to 1.4850, preferably from 1.4600 to 1.4800.

The following example illustrates the invention without limiting it.

EXAMPLES

Example 1: Production of White Oil from a Heavy Gasoil Feedstock a

Example 1a: Description of the Feed and Preparation of the Unit

A heavy gasoil feedstock A having the features detailed in table 1 below has been submitted to a catalytic hydrogenation.

TABLE 1 heavy gasoil feedstock A characterization analysis

| Characteristics and methods | values | units |
|---|---|---|
| density @ 15° C. | 0.8289 | g/mL |
| Distillation ASTM D86 T° C. @ IBP | 175.4 | ° C. |
| T° C. @ 5% vol | 202.9 | ° C. |
| T° C. @ 10% vol | 212.8 | ° C. |
| T° C. @ 20% vol | 231.9 | ° C. |
| T° C. @ 30% vol | 248.6 | ° C. |
| T° C. @ 40% vol | 265.2 | ° C. |
| T° C. @ 50% vol | 281.6 | ° C. |
| T° C. @ 60% vol | 298.8 | ° C. |
| T° C. @ 70% vol | 317.8 | ° C. |
| T° C. @ 80% vol | 341 | ° C. |
| T° C. @ 90% vol | 373.5 | ° C. |
| T° C. @ 95% vol | 0 | ° C. |
| T° C. @ FBP | 393.5 | ° C. |
| Flash point Pensky Martens ASTM D 93 | 63.5 | ° C. |
| Pour point ASTM D5950 | −13 | ° C. |
| Aniline Point ASTM D611 | 89.7 | ° C. |
| Kinematic Viscosity ASTM D445 @ 40° C. | 3.457 | $mm^2/s$ |
| Total Nitrogen by Chemiluminescence | <0.5 | ppm |
| Aromatics HPLC IP391 Mono | 9.2 | % wt |
| Aromatics HPLC IP391 Di | 0.3 | % wt |
| Aromatics HPLC IP391 Tri | 0.4 | % wt |
| Aromatics HPLC IP391 Poly | 0.4 | % wt |
| Aromatics HPLC IP391 Total | 10.3 | % wt |
| Sulphur by UVF ppm | 3.82 | ppm |

The catalyst used was a Nickel supported on alumina catalyst. The catalyst has been reduced in situ with hydrogen before introducing the feed, for example with 80 Nl/h of hydrogen for 1 hour.

Before introducing the heavy gasoil feed A, the catalytic system has been first subjected to a stabilization phase using a standard gas oil feed, at 150° C., LHSV of 1.5 $h^{-1}$ and a hydrogen pressure of 100 bars. After 60 hours on stream, a stable monoaromatic content of 10 ppm by weight was reached.

Example 1b: Process of the Invention

Then, after the stabilization phase, a catalytic dehydrogenation has been performed on the heavy gasoil feed A detailed in table 1 with the following conditions: a temperature of 150° C., a LHSV of 1 $h^{-1}$ and a pressure of 150 bars. The ratio H2/HC between the hydrogen and the feed was of 160 NL/L.

The effluent B was then distilled in six fractions B1 to B6.

The features of the effluent and the six fractions are detailed in table 2 below. The B5b fraction corresponds to the fractionation if made only on 5 fractions.

TABLE 2

Effluent and distillation cuts characterization analysis

| Analyses | Standard | B | B1 | B2 | B3 | B4 | B5 | B6 | B5b |
|---|---|---|---|---|---|---|---|---|---|
| Density at 15° C. ($kg/m^3$) | EN ISO 12185 | 824.3 | 792.6 | 814.4 | 821.7 | 830.2 | 834.4 | 844.1 | 839.4 |
| Appearance | VISUAL | clear & bright | clear & bright | clear & bright | clear & bright | clear & bright | clear & bright | clear & bright | clear & bright |
| Pensky-Martens Flash Point (° C.) | EN ISO 2719 | 65 | 48 | 76 | 103 | 131 | 164 | — | — |
| Viscosity at 40° C. ($mm^2/s$) | EN ISO 3104 | 3.372 | 1.12 | 1.558 | 2.399 | 3.908 | 6.756 | 17.410 | 10.680 |
| Aniline Point (° C.) | ISO 2977 | 85.9 | 63.5 | 67.9 | 77.1 | 85.9 | 95.4 | 108.4 | |
| mono aromatic (ppmw) | | 77 | 71 | 87 | 66 | 93 | 195 | 305 | |
| water content (ppmw) | | 18 | 24 | 20 | 11 | 18 | 24 | 9 | |
| Distillation D86 | | | | | | | | | |
| Initial Point (° C.) | D86 | 171.0 | 156.5 | 195.8 | 231.6 | 271.1 | 309.6 | 333.3 | 312.7 |
| 5% Point (° C.) | D86 | 195.1 | 166.4 | 202.5 | 241.3 | 278.8 | 318.4 | 352.7 | 327.0 |
| 10% Point (° C.) | D86 | 208.7 | 168.5 | 203.3 | 242.2 | 279.8 | 319.6 | 360.8 | 330.8 |
| 20% Point (° C.) | D86 | 228.1 | 171.6 | 205.2 | 243.3 | 280.9 | 320.5 | 362.4 | 333.6 |
| 30% Point (° C.) | D86 | 245.7 | 174.3 | 207.1 | 244.4 | 281.9 | 321.5 | 365.0 | 336.6 |
| 40% Point (° C.) | D86 | 262.4 | 177 | 208.6 | 245.8 | 283.1 | 322.4 | 367.5 | 340.5 |
| 50% Point (° C.) | D86 | 278.4 | 179.3 | 210.4 | 247.3 | 284.2 | 323.6 | 369.9 | 345.1 |
| 60% Point (° C.) | D86 | 295.1 | 181.8 | 212.5 | 249 | 285.9 | 324.9 | 373.3 | 351.1 |
| 70% Point (° C.) | D86 | 313.0 | 184.6 | 214.7 | 251 | 287.9 | 326.5 | 377.8 | 359.1 |
| 80% Point (° C.) | D86 | 334.3 | 188.3 | 217.1 | 253.6 | 290.2 | 328.8 | 384.6 | 370.9 |
| 90% Point (° C.) | D86 | 363.6 | 193.7 | 221.0 | 257.7 | 294 | 332.5 | 396.6 | 389.8 |
| 95% Point (° C.) | D86 | 384.2 | 198.6 | 224.0 | 261.4 | 297.6 | 336.0 | * | * |
| Dry Point (° C.) | D86 | 384.4 | 204.1 | 228.3 | 265.1 | 300.4 | 338.4 | * | * |

* Not measured since ASTM D86 is limited to 400° C.

The heaviest fractions B5, B6 and B5b have a monoaromatic content lower than 305 ppm by weight and satisfy the specifications of a white oil.

Example 1c: Control of the Deactivation of the Catalyst

Finally, after 540 hours of test (example 1b), the unit was set to the same conditions as of the stabilization phase and maintained for about 100 more hours, a stable monoaromatic content of 20 ppm by weight was reached, which indicates that only slight catalyst deactivation occurred.

During all the experiment, the mass balance was >99%, calculated according to the following formula:

$$\text{mass balance} = 1 - \left(\frac{\text{IN} - \text{OUT}}{\text{IN}}\right)$$

wherein IN represents the total mass of liquid and gas at the inlet of the reactor and OUT represents the total mass of liquid and gas at the outlet of the reactor.

The invention claimed is:

1. A process for producing a white oil having an initial boiling point of at least 300° C., the process comprising a step of catalytically hydrogenating a hydrocarbon feedstock at a temperature of from 80 to 190° C., at a pressure of from 50 to 160 bars, a liquid hourly space velocity of 0.2 to 5 hr−1 and a hydrogen treat rate up to 200 Nm3/ton of feed, the hydrocarbon feedstock having a sulphur content of less than 10 ppm by weight, an initial boiling point within the range from 150 to 350° C. and a final boiling point within the range from 350 to 525° C., wherein the feedstock has an aromatic content ranging from 3 to 30% by weight.

2. The process according to claim 1, wherein the feedstock comprises less than 8 ppm by weight of sulphur.

3. The process according to claim 1, wherein the feedstock has an initial boiling point ranging from 160 to 350° C.

4. The process according to claim 1, wherein the feedstock has a final boiling point ranging from 410 to 525° C.

5. The process according to claim 1, wherein the feedstock has a viscosity at 40° C. of at least 2 cSt.

6. The process according to claim 1, wherein the hydrogenating temperature ranges from 100 to 190° C.

7. The process according to claim 1, wherein the hydrogenating pressure ranges from 75 to 160 bars.

8. The process according to claim 1, further comprising a fractionating step.

9. The process according to claim 1, wherein the white oil has an aromatic content below 500 ppm by weight.

10. The process according to claim 1, wherein the white oil has an initial boiling point higher than 300° C.

11. The process according to claim 8, wherein the fractionation step is performed after the hydrogenating step.

12. A process for producing a white oil having an initial boiling point of higher than 310° C., the process comprising a step of catalytically hydrogenating a hydrocarbon feedstock at a temperature of from 80 to 190° C., at a pressure of from 50 to 160 bars, a liquid hourly space velocity of 0.2 to 5 hr−1 and a hydrogen treat rate up to 200 Nm3/ton of feed, the hydrocarbon feedstock having a sulphur content of less than 10 ppm by weight, an initial boiling point within the range from 170 to 325° C. and a final boiling point within the range from 375 to 525° C., wherein the feedstock has an aromatic content ranging from 3 to 30% by weight wherein the white oil has an aromatic content below 500 ppm by weight.

13. The process according to claim 12, wherein the white oil has an aromatic content below 350 ppm by weight.

14. The process according to claim 12, wherein the hydrogenating pressure ranges from 100 to 160 bars.

15. The process according to claim 12, wherein the hydrogenating temperature ranges from 120 to 180° C.

16. The process according to claim 12, wherein the feedstock has an aromatic content ranging from 5 to 20% by weight.

17. The process according to claim 12, wherein the feedstock has a viscosity at 40° C. of at least 3 cSt.

18. The process according to claim 12, wherein the feedstock comprises less than 6 ppm by weight of sulphur.

19. The process according to claim 12, further comprising a fractionating step.

* * * * *